US005253665A

United States Patent [19]

Guirl

[11] Patent Number: 5,253,665

[45] Date of Patent: Oct. 19, 1993

[54] INDUSTRIAL WASHERS FOR CLEANING METAL PARTS

[76] Inventor: James N. Guirl, 1590 Fenpark Dr., St. Louis, Mo. 63026

[21] Appl. No.: 898,430

[22] Filed: Jun. 15, 1992

[51] Int. Cl.[5] ..... B08B 13/00; A47B 47/05

[52] U.S. Cl. ..... 134/201; 312/263; 312/265.5

[58] Field of Search ..... 312/257.1, 263, 265.5, 312/265.6, 296; 134/115 R, 200, 201

[56] References Cited

U.S. PATENT DOCUMENTS

| | | | |
|---|---|---|---|
| 1,573,254 | 2/1926 | Lachaine | 312/263 X |
| 1,975,613 | 10/1934 | Nystrom et al. | 312/265.5 X |
| 2,869,953 | 1/1959 | Miller et al. | 312/265.5 X |
| 3,294,276 | 12/1966 | Kemp et al. | 312/265.5 X |
| 3,458,242 | 7/1969 | Williams | 312/263 X |
| 4,067,161 | 1/1978 | Rensch | 312/265.5 X |
| 4,316,295 | 2/1982 | Whitney et al. | 312/265.5 X |

*Primary Examiner*—Philip R. Coe
*Attorney, Agent, or Firm*—Norman L. Wilson, Jr.

[57] ABSTRACT

Washers for cleansing metal parts, filters, quartz tubes and the like are either drum washers, or washers in the form of cabinets equipped with sprays. Industrial washers are washers adapted for assembly line cleaning of metal parts. Separate treating zones lead to the highly cleaned metal surfaces required by many coating processes. A conveying means is usually installed in the ceilings or floors of such washers for continuous transport of fabricated metal articles therethrough, and tanks are disposed in the base of such washers. Chemical cleaning agents utilized in industrial spray washers have a significant corrosive effect on the washer equipment. Herein a life-extending solution to the corrosion problem is provided. Plastic panels are carried by framework members to form a housing over the tanks, spray assemblies and drain areas. A feature herein is the provision of framework members in the form of elongated expansion seals carrying the plastic panels while permitting expansion and contraction of the panels without buckling, without leakage or loss of seal despite differences in rates of thermal expansion of plastic and metal.

8 Claims, 3 Drawing Sheets

INDUSTRIAL WASHERS FOR CLEANING METAL PARTS

BACKGROUND OF THE INVENTION

This invention, in one of its aspects, relates to industrial washers. In a more specific aspect the invention pertains to an industrial washer having a longer than normal life. In still another of its embodiments the invention provides a multistage spray washer having a unique housing-supporting framework.

Washers for cleansing metal parts, filters, quartz tubes and the like are described in U.S. Pat. No. 4,299,245, 4,294,271, 3,998,656, 3,741,153, 3,624,750, 3,442,273, 3,174,490, 3,073,325, 2,756,455, and 2,471,506. These washers are either drum washers, or they are spray washers in the form of cabinets equipped with rotating means such as turntables disclosed in U.S. Pat. No. 4,299,245 and 4,294,271. The washers contemplated herein are not cabinets. Rather, they more closely resemble the powder spray booth of 4,928,624, but with liquid collecting means in its base, somewhat along the lines of the paint and varnish stripping system in 4,768,533.

By industrial washers we mean washers adapted for assembly line cleaning of metal parts, usually multistage units using different solutions in each stage for cleaning, chemically treating, and preparing surface of fabricated metal articles. Separate treating zones lead to the highly cleaned metal surfaces required by many coating processes. An an example, one industrial washer with which this invention is concerned is a five stage unit. Unlike prior art cabinets such units include a long room-like housing of steel panels bolted or welded to a framework. A conveying means in its ceiling, and access openings in its ends permit continuous transport of fabricated metal articles therethrough. Tanks are disposed in the base of the washer for washing chemicals. Drainboards separate the chemical tanks, and heat exchangers are provided for the tanks, along with spray manifolds, sprays, exhaust means, pumps, and conveyors for the metal parts being treated. Some stages operate at high temperatures, while others operate under ambient conditions. Processes in which the metal articles thus cleaned will be used include those utilizing powders such as plasma coating techniques, and electrostatic procedures, as well as coating processes utilizing liquids such as organic coating compositions, say, paints, lacquers, resins, varnishes, and the like.

Traditionally each stage of a multistage washer represents a specific process. Some of the stages utilize only ambient rinse water (tap water), whereas others are adapted to handle low concentrations of chemicals. As an example caustics, or alkalies are employed in the first stages. Iron or zinc phosphates are used in third stages, and dilute phosphoric acid in fifth stages, with rinse stages in-between. Variations include additional stages in which dilute muriatic acid, sulfuric acid, and deionized water can be used. Deionized water is especially preferred for use in the last stage.

It is to be emphasized that the chemical cleaning agents utilized in industrial spray washers have a significant corrosive effect on the washer equipment. Since the chemicals employed are either alkaline or acidic in nature, and since they are accompanied by high volumes of moisture there is a generally consistent pattern of washer degradation over the life of the equipment. This has been found to be the case even when the washer is fabricated of stainless steel. Generally multistage spray washers are fabricated with steel plate in the housing and in the base areas, the base areas being drainboards, tanks and grills covering the tanks.

In thirty years of observations I have found that even stainless steel deteriorates, shortening the life of the washer unit. Although deterioration occurs around such openings as access doors and sumps, examinations over this period revealed that the highest rate of degradation occurs in the housing above the base. Quite surprisingly, it was found that the worst deterioration occurred in the rinse stages. Even more unexpectedly it was realized that the areas subject to extreme corrosion were those in which a high interchange of air and water vapor occurred, apparently leading to greater oxidation. At any rate the mixture of residual chemicals, moisture and air appears to accelerate the corrosion of the housing. Our study also revealed that attrition diminished from the top down, being less pronounced toward the lower portions of the housing, and nominal in the drainboard and tank areas which are subjected to liquid flow.

Various modifications to multistage washers have been suggested over the years to overcome housing corrosion, but they have not performed without limitations. Use of plastic walls has been unsuccessfully attempted due to the fact that high temperatures are used in some stages and that plastic expands four times as much as steel. Accordingly suggested remedies have been along other lines, such as construction of stainless steel, and housing coatings of various types.

The corroded housing could be replaced with stainless steel. However, given the size of these multistage washers, which are as usually as large as a railroad boxcar, this would be tantamount to a prohibitively expensive unit replacement. Resinous interior housing coating materials such as epoxies, polyesters, PVC linings and the like also have their drawbacks. Besides the added expense their use leads to future problems. Lining disintegration and loss of adhesion are common under conditions of use. When the coatings do break down, resulting contamination of the washer creates more severe problems than no coating protection at all.

Since operating conditions do lead to a high incidence of housing corrosion, it has long been my desire to find a commercially acceptable solution to that corrosion problem which will extend the life of multistage washers. As indicated, although coating of the housing with a resin is possible, such a solution leads to future problems. Plastic walls have been tried, but they too were discarded as unsuccessful because of expansion difficulties. Hence, industrial washers of the type discussed remain subject to improvement. This invention provides a life-extending solution to the problem, leading to the provision of industrial washers at no added cost.

SUMMARY OF THE INVENTION

Recapping, industrial washers are quite widely used for cleaning and chemically treating metal surfaces with spray at elevated temperatures to prepare them for such uses as coating processes. These spray washers include a framework, and corrosion resistant metal panels carried thereby as walls which form a washer housing. Tanks and connecting drain areas form the base of the washer housing. Spray assemblies are disposed within the housing, and means connected to them convey cleaning solutions from the tanks to the spray assemblies. Overcoming the problem of corrosion and accompanying deterioration of housing walls above the tanks, we have discovered means for using plastic walls on the metal base, and on metal framework, despite their different rates of expansion. The improvement herein includes horizontal and vertical top, bottom, and side framework members over the tanks, drain areas, and spray assemblies, in combination with plastic panels having a greater degree of corrosion resistance than the previously employed metal panels. The plastic panels are carried by the framework members to form a housing over the tanks, spray assemblies and drain areas. A feature of the invention herein is the provision of framework members in the form of elongated expansion seals carrying the plastic panels while permitting expansion and contraction of the panels without buckling, without leakage or loss of seal despite differences in rates of thermal expansion of plastic and metal, and without the need for bolts in the housing section.

THE INVENTION

The use of plastic panels is rendered possible by this invention because, unlike prior art horizontal and vertical framework members which support washer housing panels, the framework members herein are elongated expansion seals preventing fluid flow along the plastic panel edges seated therein. An understanding of the type of washers to which this invention applies, and of the unique framework members, can, perhaps, best be obtained from a description in conjunction with drawings. A commercial washer is depicted, and that unit will first be described. The invention herein, illustrated in the remaining figures in the drawings, will then be explained.

THE DRAWINGS

Figure 5:
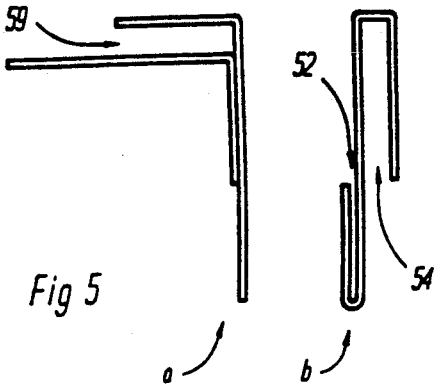

In FIGS. 5 *a* and *b* are end views of corner and regular framework members.

Figure 3:
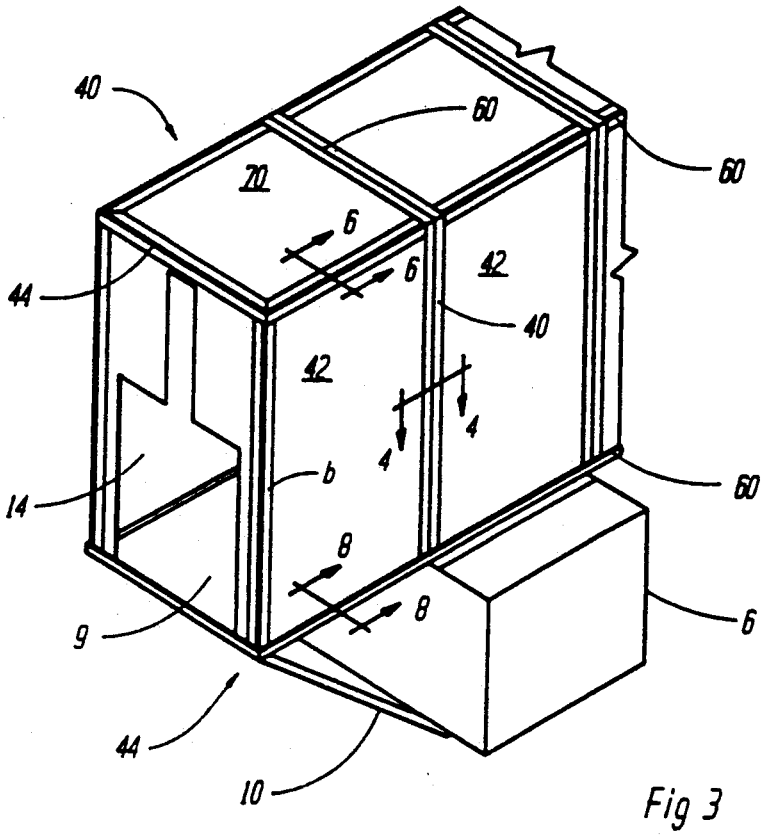
FIG. 3 is an isometric view of a washer of the invention.
Figure 6:
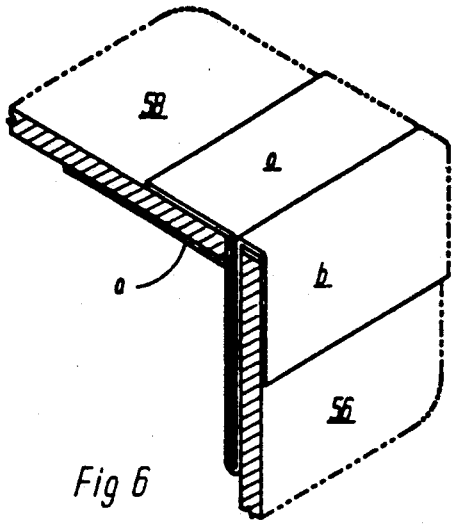

FIG. 6 is a cross-sectional view taken through 6—6 of FIG. 3 to show how the framework members of FIG. 5 are used in corners.

Figure 7:
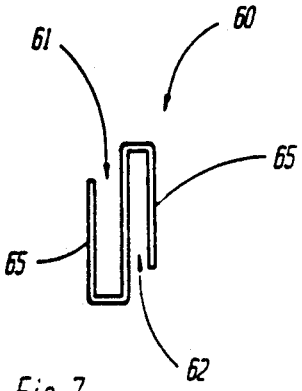

FIG. 7 is an end view of the horizontal framework members of this invention.

Figure 8:
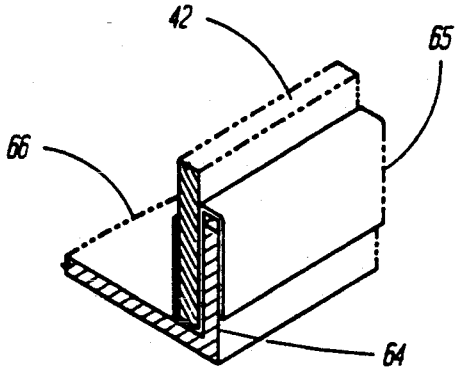

FIG. 8 is a cross sectional view taken through 8—8 of FIG. 3 to illustrate how the housing is attached to the housing base.

Figure 9:
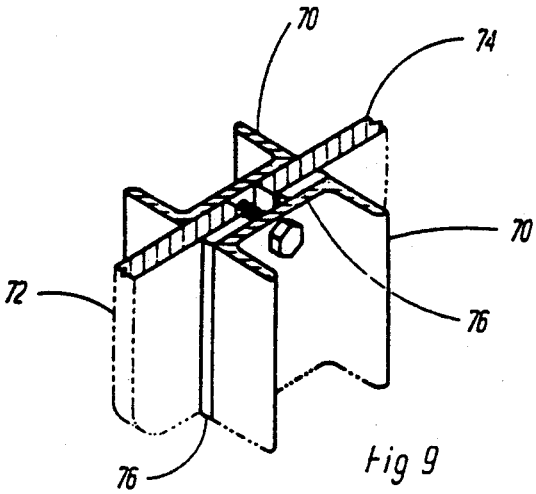

FIG. 9 illustrates a different form of the expansion seal of the invention.

DETAILED DESCRIPTION OF THE INVENTION

Figure 1:
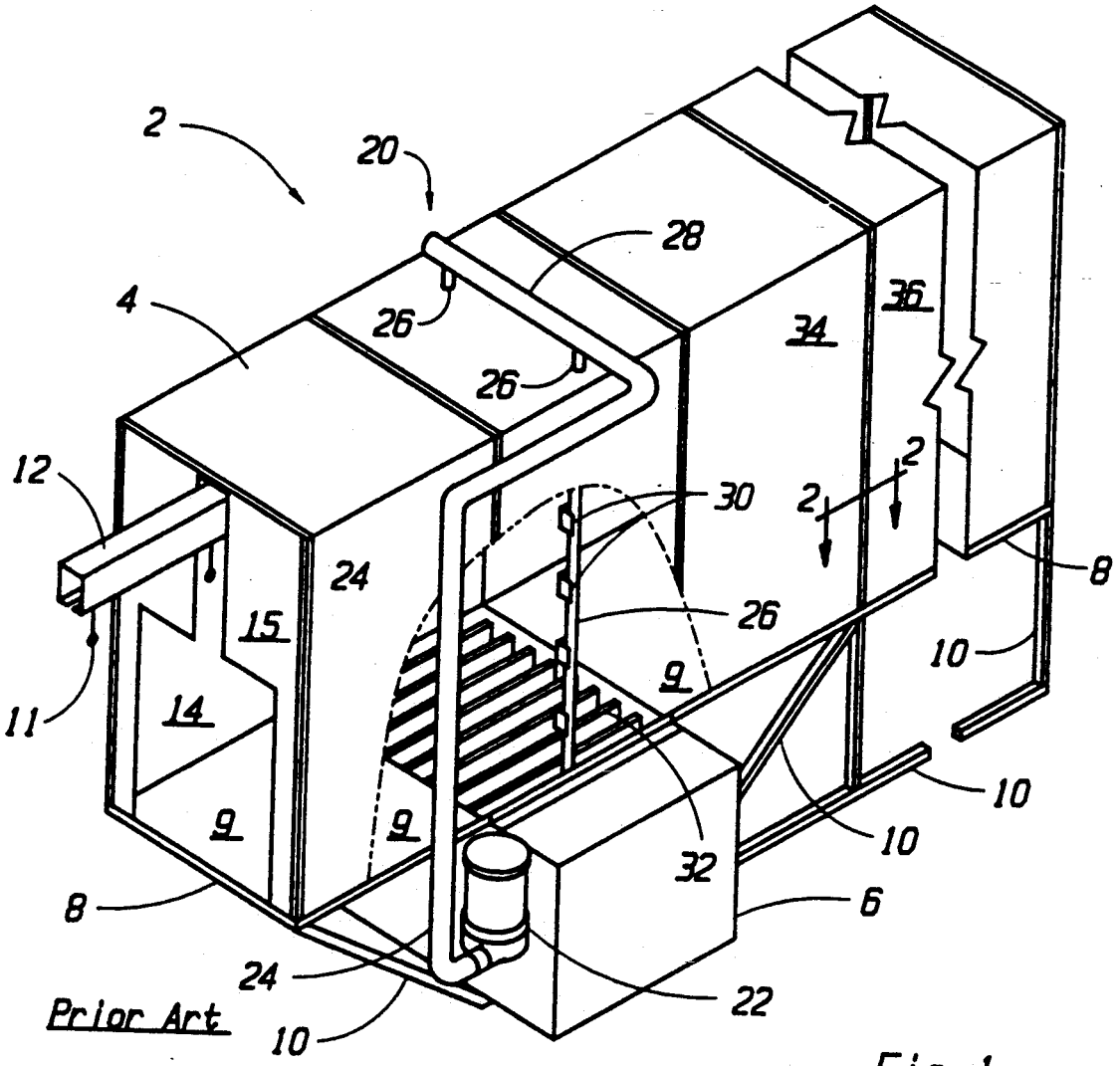
Prior Art Fig 1
FIG. 1 is an isometric view of a highly commercial multistage washer, partially cut away to show interior elements.

Referring first to the commercial washer illustrated in FIG. 1, a multistage washer 2, with its housing 4 fabricated over tanks 6 can be seen. As indicated it more or less resembles a railroad car. The base portion 8 includes a number of tanks 6 and adjoining drain areas 9 equal to the number of washing stages. Conventionally, industrial washers are fabricated in anywhere from two to six, and sometimes seven stages, discernible from the number of tanks which are visible on the floor beneath base 8 of the unit. Base portion 8 also includes a frame section 10 providing additional support.

Fabricated metal articles to be cleaned are hung from hooks 11 on overhead conveyor 12 and conveyed through an opening 14 in one end panel 15 of washer 2, and out of the washer through a corresponding opening in an oppositely fabricated end panel (not shown).

A fluid dispensing system 20 is installed in the housing on each side of, and above, the path traveled by the article being subjected to the washing action of chemical solutions or water which cleanse the article as it moves through each washing zone. This spray system includes circulating pumps 22, connecting riser piping 24, and spray manifolds 26 and 28 having spray nozzles 30 affixed thereto, in an arrangement providing an appropriate spray envelope. Spray from nozzles 30 falls on drainboards 9 and flows back into an adjacent open-top tank 6, to be recirculated by pump 22. Tanks 6 are adapted with gas fired or other heating units which maintain tank temperatures. In addition each tank 6 is provided with a catwalk or grill 32 over its top for maintenance.

Figure 2:
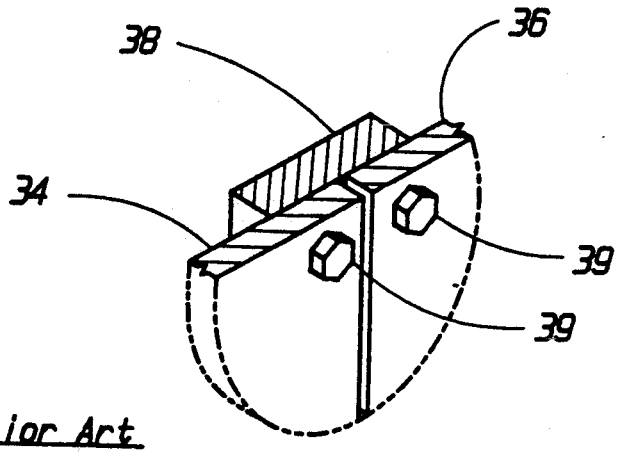
Prior Art Fig 2
FIG. 2 is a washer section taken through 2—2 of FIG. 1 to show how steel housing panels are attached.

Since the invention herein is concerned with the panels of the washer housing 4, the conventional panel fabrication is shown in FIG. 2. Adjacent panels 34 and 36 are bolted to framework structural members 38 by bolts 39 as shown in a cross section taken through 2—2 of FIG. 1.

Having described the industrial washers to which this invention applies, the drawbacks of such washers will now be considered. Prior art units have been constructed of 1018-20 mild steel. However, because of the fact that the chemicals used and the generally high moisture content in the washer lead to corrosion, a fairly consistent pattern of degradation of the housing occurs over the life of the equipment. I have found that the base of the unit, that is the tanks, drain areas, circulation system and the like always outlash the housing. In other words the tanks, drainboards and allied equipment do not present the problem of degradation and replacement that the housing does. In actual fact they usually last two to three times as long as the housing. There is, then, a need for a different type of housing wall. I concluded that plastics such as polyolefins had to be considered despite problems arising from the significant difference in the rates of expansion of the steel and plastic. And I have now solved the problems arising from the integration of two dissimilar materials into a single unit.

Through the use of the unique framework to be described we are able to utilize four by eight foot heavy gage plastic sheets or panels with steel framework and base structures. Whereas of the polyolefin sheets, polypropylene panels are preferred, other plastic sheets, say one-eighth to one-fourth inch thick having the appropriate chemical and temperature resistance properties will occur to those skilled in the art. One such plastic is polycarbonate sheets such as those used in the aircraft industry. Others are fluoroplastics (FEP), terephthalate polyesters, vinylchloride-acetate copolymers, PVC, other polyolefins, particularly high density polypropylene, and acrylonitrile-butadiene-styrene (ABS) polymers.

An overall view of the washer 40 of the invention is shown in FIG. 3. The end opening 14, conventional tanks 6, drain areas 9, and base framework 10 are shown, but the main purpose of the figure is to serve as a cross-sectional basis for the housing framework and panels of this invention. It will be apparent that the panels 42 are supported in a special framework 44, permitting the plastic housing to expand to a greater extent than the washer base and framework. The framework allows for the greater expansion of the plastic panels without accompanying buckling, and yet prevents leakage from the spray action inside the housing.

One of the desiderata of this invention is the fact that the members of framework 44 are elongated expansion seals. Desirably labyrinth construction is used in rendering framework members expansion seals.

Figure 4:
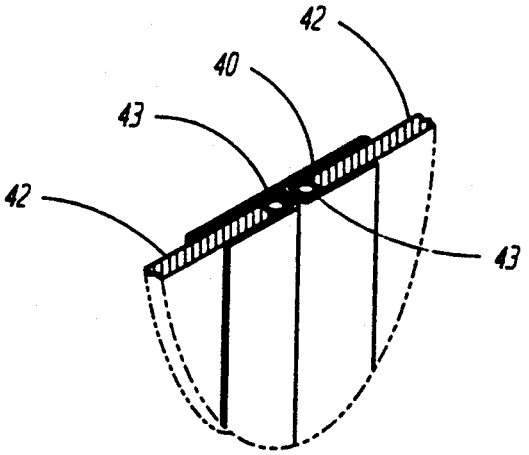
FIG. 4 is a cross section similar to that in FIG. 2 and taken through 4—4 of FIG. 3 to show how plastic housing panels are attached by this invention.

Vertical washer framework members 40 are shown in FIG. 4. In addition to functioning as housing panel supports, these framework members are also elongated expansion seals. They are similar in labyrinth construction to the horizontal expansion seal-framework members to be described, but they are modified due to fluid down flow. The expansion seal 40 is fabricated with back to back U-shaped channels receiving housing panels 42. Since diagonal fluid downflow has a greater tendency to pass through the labyrinth seal, the oppositely disposed channels have flexible seals or gaskets 43 affixed against the channel backs as shown in FIG. 4.

From FIG. 4 it will be evident that as plastic panels 42 contract, flexible seals 43 expand to maintain the seal. When the plastic panels 42 expand, flexible seals 43 will be compressed.

Wall and ceiling corner housing construction illustrated in FIGS. 5 and 6 will now be described. FIG. 6 shows that labyrinth fabrication is utilized even in corner construction. The corner members are designated a and b in FIG. 5. As can be seen in FIG. 6 corner framework member a and framework member b form a corner coupler. Corner framework member a fits in channel 52 of corner framework member b. FIG. 6 is a cross section taken through 6—6 of FIG. 3. Hence it also shows housing panels 56 and 58 in place in the corner coupler. Channel 54 of corner coupler b hooks over the top of vertical plastic panel 56. Horizontal panel 58, on the other hand, is inserted in channel 59 of panel coupler element a. It is to be understood that both vertical and horizontal corners will use corner couplers such as a and b. of FIG. 5. It remains, then, to describe the horizontal expansion seals. These are illustrated in FIGS. 7 and 8. The horizontal framework members are essentially offset, oppositely directed, joined U-shaped members, with one U directed upwardly and one U-shaped member directed downwardly as seen in FIG. 7. In cross section the members might be considered to be substantially S-shaped with their oppositely directed channels 61 and 62 adapted to hold adjacent plastic panels. How these panels are held is shown in FIG. 8, which is a cross section taken through 8—8 of FIG. 3. The upper plastic panels 42 are supported because their bottom ends rest in upwardly directed channel opening 61 of horizontal framework member 60. The lower panels are held in place because their upper edges are confined in a downwardly directed channel 62.

FIG. 8 illustrates the attachment of the housing to the washer base. This is a cross section through 8—8 of FIG. 3. A short panel 64 is attached to the washer base 66. The downwardly directed opening channel 62 fits over this panel 64. Arms 65 of the U-shaped members will be as long as required to provide the labyrinth seal preventing fluid flow both downwardly and upwardly through the framework labyrinth.

Summarizing, FIG. 3 shows a plastic housing with housing panels 42 and 70 borne by horizontal and vertical expansion seals as framework members, along with corner couplers described hereinbefore. Preferred expansion seals are labyrinth framework members with or without flexible seals, and with both vertical and horizontal framework members permitting plastic panel expansion and contraction. In the light of the description of the invention given herein ramifications and variations will occur to those skilled in the art. Thus exhaust means can be installed on top of the washer. In addition, whereas the expansion seals described are labyrinth seals, and labyrinth seals having flexible elements or gaskets in their channels, the framework structural members can be fabricated to form other types of expansion-permitting seals. One such expansion seal is illustrated in FIG. 9. Iron straps, which can be various structural shapes such as angle irons 70 for strength purposes, are bolted together by metal screws 71 with panels 72 and 74, along with a flexible strip or gasket 76 therebetween. It is evident from the figure that screw 71, while passing through flexible gasket 76, does not pass through plastic panels 72 or 74. The pressure applied by the metal angle irons compress gasket 76 to prevent leakage while still allowing panels 72 and 74 to expand. As another embodiment of the invention, it will be evident that flexible members in channels in the vertical framework can be eliminated if the channels are deep enough. It will also be obvious that the washer framework can be adapted to any size plastic panel. Thus, whereas four by eight foot panels have been described, they can be ten by twelve or larger, as well as smaller, and thicker or thinner. Moreover, various flexible seals are commercially available.

The structure shown in FIG. 8 includes a horizontal member having arms 65 holding the washer base, 66. It will be appreciated that it can also be used to hold another vertical panel such as panel 56 shown in FIG. 6. Likewise in addition to the variety of plastics useful herein, reinforced plastics can be used as washer panels. It will be appreciated too that whereas one form of industrial washer has been illustrated, each manufacturer makes a different version. For example a conveying belt system in the floor of the washer may take the place of the ceiling unit described. In any event the plastic housing herein, with structural members shaped to form elongated expansion seals will lend itself to use on any of these industrial washers. Such modifications as these are, therefore, deemed to be within the scope of this invention.

What is claimed is:

1. In an industrial spray washer for cleaning and chemically treating surfaces of metal articles with spray of aqueous cleansing agents to prepare them for such uses as coating processes, wherein the spray washer includes a washer tank, and a drainboard affixed to the washer tank, the combination of the tank and drainboard forming a washer base area, a spray assembly carrying nozzles directing spray on an article when it is held above the washer base area so that spray flows from the drainboard into the tank, means conveying cleaning solution from the washer tank to the spray assembly, and a washer housing having walls enclosing the spray assembly and the base area, said housing including horizontal and vertical top, bottom, and side metal framework members and wall panels affixed to the framework members to form walls of the washer housing, the improvement comprising the wall panels being plastic to thus form corrosion resistant housing walls, the framework members being in the form of elongated expansion seals to allow expansion of the plastic wall panels while preventing fluid flowthrough along edges of the plastic wall panels seated in the framework members, and wherein the plastic wall panels are seated in the expansion seals without being bolted in them and without loss of seal despite differences in rates of expansion of plastic and metal, thus permitting expansion and contraction of the plastic wall panels without buckling.

2. The industrial washer of claim 1 wherein the washer is a multistage washer.

3. The multistage washer of claim 2 wherein the plastic wall panels are sheets of heavy gage polypcarbonate.

4. The multistage washer of claim 2 wherein the plastic wall panels are sheets of heavy gage polypropylene.

5. The multistage washer of claim 4 wherein the polypropylene panels are rectangular sheets.

6. The multistage washer of claim 2 wherein the elongated expansion seals are labyrinth seals.

7. The multistage washer of claim 6 wherein vertical labyrinth seals carry flexible gaskets therewithin.

8. The multistage washer of claim 7 wherein the vertical labyrinth seals are in the form of two structural U-shaped channel members adapted to receive plastic panels, and connected back-to-back with their U-channel openings oppositely directed, each channel opening having a flexible seal therein as a seat for its plastic panel.

* * * * *